US008661842B2

(12) United States Patent
Kim et al.

(10) Patent No.: US 8,661,842 B2
(45) **Date of Patent: *Mar. 4, 2014**

(54) ICEMAKER IN REFRIGERATOR

(75) Inventors: Jong Gon Kim, Gyeongsangnam-do (KR); Oh Chul Kwon, Gyeongsangnam-do (KR); You Min Park, Gyeongsangnam-do (KR); Young Hoon Gwak, Gyeongsangnam-do (KR); Hyeon Po Cho, Gyeongsangnam-do (KR); Bon Young Koo, Gyeongsangnam-do (KR); Myung Soo Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 292 days.

This patent is subject to a terminal disclaimer.

(21) Appl. No.: 12/899,775

(22) Filed: Oct. 7, 2010

(65) Prior Publication Data

US 2011/0023523 A1 Feb. 3, 2011

Related U.S. Application Data

(63) Continuation of application No. 11/747,504, filed on May 11, 2007, now Pat. No. 7,823,408.

(30) Foreign Application Priority Data

May 12, 2006 (KR) ..... 10-2006-0043022

(51) Int. Cl.

| | |
|---|---|
| ***F25C 5/08*** | (2006.01) |
| ***F25C 5/18*** | (2006.01) |
| ***F25C 1/22*** | (2006.01) |

(52) U.S. Cl.

USPC ..... 62/351; 62/344; 62/340

(58) Field of Classification Search

USPC ..... 62/300, 351, 219, 340, 341, 344, 237, 62/330, 347; 426/515

See application file for complete search history.

(56) References Cited

U.S. PATENT DOCUMENTS

| | | | | |
|---|---|---|---|---|
| 2,782,608 | A | 2/1957 | French et al. | |
| 3,775,992 | A * | 12/1973 | Bright | 62/73 |
| 4,754,615 | A | 7/1988 | Linstromberg | |
| 6,050,097 | A | 4/2000 | Nelson et al. | |
| 7,823,408 | B2 * | 11/2010 | Kim et al. | 62/351 |
| 8,047,015 | B2 * | 11/2011 | An et al. | 62/340 |

FOREIGN PATENT DOCUMENTS

| | | | |
|---|---|---|---|
| JP | 06159877 | A * | 6/1994 |
| KR | 10-2005-045493 | A | 5/2005 |
| KR | 10-2005-069319 | A | 7/2005 |
| KR | 2005069319 | A * | 7/2005 |

* cited by examiner

*Primary Examiner* — Chen Wen Jiang
(74) *Attorney, Agent, or Firm* — Fish & Richardson P.C.

(57) ABSTRACT

An icemaker in a refrigerator is disclosed, by which heat generated from a heater to detach ice is prevented from being transferred to an inside of the refrigerator. The present invention includes an icemaker body provided to a prescribed position of the refrigerator to make to ice from a supplied water, a heater provided to the icemaker body to generate heat to facilitate detachment of the made ice, and a heater shielding unit provided to prevent the heat generated from the heater from being supplied to an inside of the refrigerator.

12 Claims, 6 Drawing Sheets

ICEMAKER IN REFRIGERATOR

CROSS-REFERENCE TO RELATED APPLICATIONS

This application is a continuation of U.S. application Ser. No. 11/747,504, filed May 11, 2007, now allowed, which claims the benefit of a foreign priority application filed in Korea as Serial No. 10-2006-0043022 on May 12, 2006, both of which are incorporated by reference.

BACKGROUND OF THE INVENTION

1. Field of the Invention

The present invention relates to a refrigerator, and more particularly, to an icemaker in a refrigerator. Although the present invention is suitable for a wide scope of applications, it is particularly suitable for making ice in a refrigerator.

2. Discussion of the Related Art

Generally, a refrigerator is a device for storing food at a low temperature. The refrigerator is a home appliance for storing food in a frozen or cold state and tends to have a large scale with multi-functions to meet various kinds of consumer's tastes and the enhanced standard of living. Moreover, various convenient devices are provided to a refrigerator and internal configurations of refrigerator are diversified to fit the user's tastes and usages.

An icemaker in a refrigerator according to the present invention is applicable to various refrigerator configurations. In the following description, a bottom freezer type refrigerator, of which body is partitioned into upper and lower parts respectively corresponding to a cool chamber and a freezing chamber, is taken as an example for the description.

FIG. 1 is a front diagram of an exterior of a general refrigerator.

Referring to FIG. 1, a body 100 of a refrigerator approximately has a rectangular parallelepiped shape. An internal space of the body 100 is partitioned into upper and lower parts to configure a cooling chamber 110 and a freezing chamber 115.

A refrigerator door 120 is provided to an opening of a front side of the body 100. The refrigerator door 120 is provided to selectively open/close the open front side of the body 100, and more particularly, open front sides of the cooling and freezing chambers 110 and 115 and includes a cooling chamber door 122 and a freezing chamber door 128.

The cooling chamber door 122 selectively opens/closes the cooling chamber 110 provided to the upper part of the body 100. Like doors of a side-by-side type refrigerator, a pair of cooling chamber doors 122 are provided to left and right sides and rotatably configured to selectively open/close the cooling chamber 110 centering on both side axes, respectively.

And, the freezing chamber door 128 is provided to selectively open/close the freezing chamber 115 provided to the lower part of the body 100 and configured to have a drawer shape. So, the freezing chamber door 128 slides in or out back and forth to selectively open/close the freezing chamber 115.

Meanwhile, a dispenser 130 is provided to one of the left and right cooling chamber doors 122 opening/closing the cooling chamber 110. The dispenser 130 facilitates purified water or ice to be taken out without opening the cooling chamber door 122 and is provided to be exposed to a front side of the cooling chamber door 122.

FIG. 2 is a perspective diagram of a backside of a cooling chamber door shown in FIG. 1, in which an icemaker 10 provided to the backside of the cooling chamber door is shown.

Referring to FIG. 2, an ice-making room 140 is provided to a backside of the door 122 provided with the dispenser 130. and, an icemaker 10 is provided within the ice-making room 140 to make ice.

The ice-making room 140 is configured with a part recessed into an inner case 124 configuring the backside of the door 122. The ice-making room 140 is selectively open/close by an ice-making room door 148 rotatably provided to one side.

The icemaker 10 making ice, an ice bank 144 storing the ice made by the icemaker 10, and a transferring device 146 transferring the stored ice to a taking-out part of the dispenser 130 are provided within the ice-making room 140. And, they are directly assembled to an inner lateral side of the ice-making room 140, i.e., to the inner case 124.

However, the related art icemaker has the following problems.

First of all, the related art icemaker includes a heater to facilitate the ice to be separated. Yet, if heat from the heater is radiated into the refrigerator, objects stored at low temperature within the refrigerator are heated.

Secondly, if the heat from the heater is supplied into the refrigerator, the refrigerator is overloaded.

SUMMARY OF THE INVENTION

Accordingly, the present invention is directed to an icemaker in a refrigerator that substantially obviates one or more problems due to limitations and disadvantages of the related art.

An object of the present invention is to provide an icemaker in a refrigerator, by which heat generated from a heater to detach ice is prevented from being transferred to an inside of the refrigerator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an icemaker, which is provided to a refrigerator to make ice, according to the present invention includes an icemaker body provided to a prescribed position of the refrigerator to make to ice from a supplied water, a heater provided to the icemaker body to generate heat to facilitate detachment of the made ice, and a heater shielding unit provided to prevent the heat generated from the heater from being supplied to an inside of the refrigerator.

Therefore, the present invention can prevent heat generated from a heater to detach ice from the icemaker from being transferred to an inside of the refrigerator.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 3:
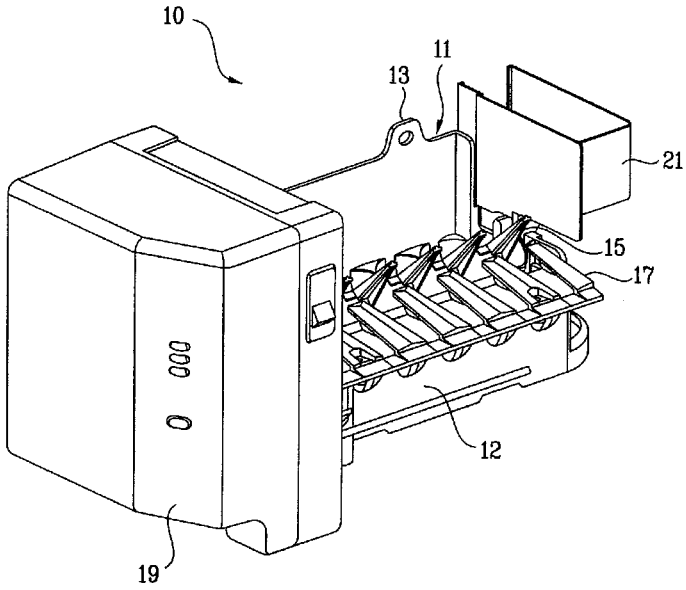
FIG. 3 is a perspective diagram of an icemaker in a refrigerator according to one embodiment of the present invention.
Figure 4:
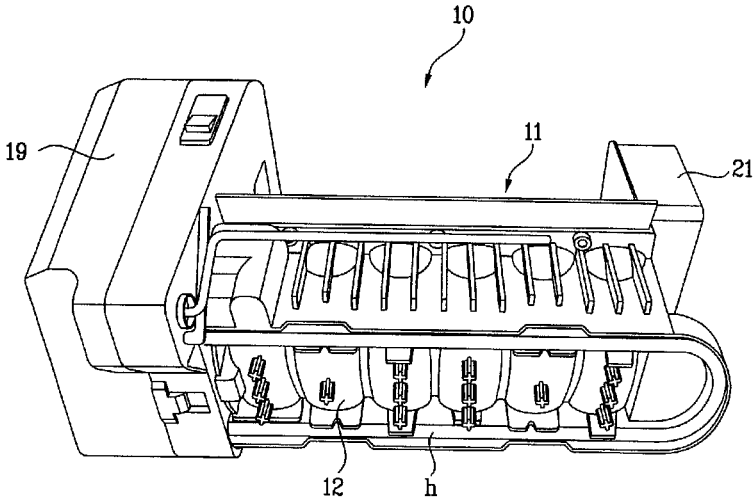
FIG. 4 is a perspective diagram of a backside of the icemaker shown in FIG. 3.

FIG. 3 is a perspective diagram of an icemaker in a refrigerator according to one embodiment of the present invention, and FIG. 4 is a perspective diagram of a backside of the icemaker shown in FIG. 3.

Referring to FIG. 3 and FIG. 4, an icemaker 10 includes an icemaker body 11 making ice and a heater (cf. 'h' in FIG. 4) supplying heat to facilitate ice detachment.

The icemaker body 11 includes an ice-making tray 12 and a loading flange 13. The ice-making tray 12 is supplied with water from a water supply hopper 21 to substantially make ice therein. At least one pair of loading flanges 13 are provided to one side of the icemaker body 11 to enable the icemaker 10 to be loaded in a storage space of the refrigerator, e.g., in a freezing chamber in general.

Meanwhile, an ejector 15 can be provide to one side of the icemaker body 11 corresponding to an upper side of the ice-making tray 12. The ejector 15 is provided to take out the ice made by the ice-making tray 12. And, the ejector 15 is rotatably provided to the icemaker body 11.

A stripper 17 can be provided to the other side of the icemaker body 11 to oppose the ejector 15. And, the stripper 17 plays a role in preventing the ice from re-entering the ice-making tray 12 in the course of taking out the ice made in the ice-making tray 12 using the ejector 15.

Preferably, the heater h, as shown in FIG. 4, is provided to a bottom of the ice-making tray 12. The heater h provides heat to facilitate the detachment of the ice made in the ice-making tray 12. In particular, in case that the ice is attached to the ice-making tray 12, the heat is supplied by the heater h to partially melt the ice. So, the ice can be easily detached from the ice-making tray 12. The detached ice is then taken out by the ejector 15.

The icemaker 11 body can include a housing 19. Various parts are installed within the housing 19. For example, a driving motor (not shown in the drawings) for driving the ice-making tray 12, the ejector 15 and the like is installed within the housing 19.

Meanwhile, the water supply hopper 21 is provided to the icemaker body 11. The water supply hopper 21 temporarily stores water supplied from such an external water supply source as a tap or a water supply source such as a water tank (not shown in the drawings) provided to the refrigerator and then supplies the stored water to the ice-making tray 12. And, the water supply hopper 21 is placed over the ice-making tray 12 relatively. The water supply hopper 21 is configured to have a hexahedral shape of which topside and one lateral side are open. And, one end of a water supply hose (not shown in the drawings) connected to the water supply source is fixed to the open one lateral side of the water supply hopper 21.

As mentioned in the foregoing description, the above-configured icemaker is provided with the water supplied from the external water supply source or the separate water supply source provided to the refrigerator via the water supply hose. And, the icemaker includes the water supply hopper 21. Yet, in order to prevent water flowing within the water supply hose from being frozen, the water supplied via the water supply hose has a relatively high water pressure. So, it may happen that the water supplied to the water supply hopper 21 via the water supply hose may splash out of the water supply hopper 21 due to the high water pressure. The splashing water is frozen onto an inside of the refrigerator to deteriorate a fine view and cause malfunctions of the internal elements of the refrigerator.

So, an icemaker in a refrigerator according to another embodiment of the present invention includes a splash preventing unit to prevent water of a water supply hopper from splashing, which is explained with reference to the attached drawing as follows.

Figure 5:
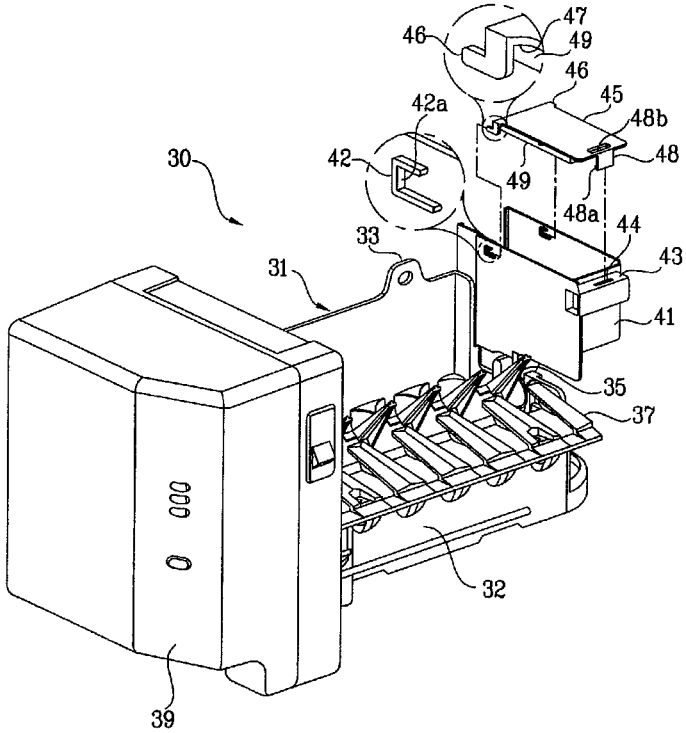
FIG. 5 is a perspective diagram of an icemaker in a refrigerator according to another embodiment of the present invention.

FIG. 5 is a perspective diagram of an icemaker in a refrigerator according to another embodiment of the present invention.

Referring to FIG. 5, compared to the former embodiment of the present invention, an icemaker 30 in a refrigerator according to another embodiment of the present invention is characterized in including a hopper cover 45 constructing a splash preventing unit that prevents water from being splashed out of a water supply hopper 41. The differences between the former and latter embodiments of the present invention are mainly explained as follows.

First of all, an open topside of the water supply hopper 41 is selectively opened/closed by the hopper cover 45. For this, the hopper cover 45 has a rectangular shape corresponding to the open topside of the water supply hopper 41.

The hopper cover 45 is detachably provided to open/close the open topside of the water supply hopper 41. In particular, the hopper cover 45 is provided rotatable within a range of a prescribed angle centering on one later side of the water supply hopper 41 to be fixed thereto. Namely, the hopper cover 45 is fixed to the water supply hopper 41 by rotating at a prescribed angle centering on one lateral side of the water supply hopper 41. In case of being separated from the water supply hopper 41, the hopper cover 45 is separated by rotating at a prescribed angle. For this, the icemaker 30 in the refrigerator according to the present embodiment includes a rotational motion fixing part rotatably fixing one end portion of the hopper cover 45 and a locking part locking the other end portion of the hopper cover 45.

In this case, the rotational motion fixing part can include at least one locking projection 46 projected from one end portion of the hopper cover 45 and a locking rib 42 having a locking recess 42*a* opposing the locking projection 46 to be provided to the water supply hopper 41.

In particular, the locking rib 42 is provided to each upper end of both opposing lateral sides of the water supply hopper 41. The locking rib 42 is provided to lock the hopper cover 45 to the water supply hopper 41. So, the locking rib 42 is provided to one side of each upper end of both of the opposing lateral sides adjacent to one open lateral side of the water supply hopper 41. And, the locking rib 42 is outwardly projected from each of both of the opposing lateral sides of the water supply hopper 41.

In this case, the locking rib 42 is configured to have a '⊓' shape to have the locking recess 42*a* therein. And, the locking projection 46 of the hopper cover 45 is fitted into the locking recess 42*a*. In particular, if the locking projection 46 is fitted into the locking recess 42*a*, the hopper cover 45 is rotatable at a prescribed angle. This will be explained in detail later.

A pair of the locking projections 46 are provided to one end portion of the hopper cover 45 corresponding to the locking ribs 42, respectively. The locking projection 46 extends from each of both end portions of one side of the hopper cover 45 to configure a '⌟' shape. When the hopper cover 45 closes the open topside of the water supply hopper 41, a front end portion of the locking projection 42 is inserted in the locking recess 42*a*.

Besides, the locking recess can be configured to have a circular shape with a prescribed curvature. Yet, it may not be configured to have the circular shape unlike FIG. 5. So, in order for the hopper cover 45 to rotate at a prescribed angle, at least one of the locking projection 46 and the locking rib 42 is formed of an elastic substance. If at least one of the locking projection 46 and the locking rib 42 becomes elastic, it is elastically transformed to enable the rotational motion of the hopper cover 45.

And, an insertion recess 47 is provided to each of both of the opposing lateral sides of the hopper cover 45. So, the upper ends of the opposing lateral sides of the water supply hopper are inserted in the insertion recesses 47, respectively. The insertion recess 47 is substantially configured with an inner side of the locking projection 46 and an outer side of a protruding member 49 that will be explained later.

Meanwhile, the locking part can include a locking hook 48 provided to the other end portion of the hopper cover 45 and a locking piece 43 provided to the water supply hopper 41 in correspondence to the locking hook 48.

In particular, the locking piece 43 is provided to a center of an upper end of one side between a pair of the opposing lateral sides of the water supply hopper 41. The locking piece 43 is projected outwardly from one lateral side of the water supply hopper 41. A locking hole 44 is provided to the locking piece 43 to be locked by the locking hook 48.

The locking hook 48 is provided to a position most distant from both of the later side end portions of the hopper cover 45 provided with the locking projections 46, i.e., to a center of the other end portion of the hopper cover 45 corresponding to the opposite side of the locking projection. The locking hook 48 has prescribed elasticity and downwardly extends from a bottom of the hopper cover 45 to be elastically locked to the locking hole 44.

And, a front end of the locking hook 48 is provided with a holding sill 48*a*. Once the locking hook 48 is locked to the locking hole 44, the holding sill 48*a* closely adheres to a bottom of the locking piece 43 adjacent to the locking hole 44 to substantially play a role in locking them together.

Meanwhile, an elastic opening 48*b* is provided to one side of the hopper cover 45 adjacent to the locking hook 48. The elastic opening 48*b* plays a role in giving a prescribed elastic force to the locking hook 48 to enable the locking hook 48 to be elastically transformed in the course of being locked to the locking hole 44.

Preferably, the protruding member 49 is provided to the bottom of the hopper cover 45 in the refrigerator icemaker according to the present embodiment. While the hopper cover 45 closes the open topside of the water supply hopper 41, the protruding member 49 plays a role in sealing them.

In this case, the protruding member 49 is provided to both lateral side end portions of the hopper cover 45 and end portions between both of the lateral side end portions of the hopper cover 45, i.e., to a position inwardly spaced apart with a prescribed distance from a circumference of the hopper cover 45 provided with the locking projections 46 and the locking hook 48. The protruding member 49 downwardly extends from the bottom of the hopper cover 45 to a prescribed length. So, once the hopper cover 45 covers the open topside of the water supply hopper 41, the protruding member 49 closely adheres to inner upper ends of both of the opposing lateral sides of the water supply hopper 41 and inner upper ends of both sides between the opposing lateral sides of the water supply hopper 41.

Meanwhile, the above-configured icemaker shown in FIG. 4 has a problem that heat from the heater h enters the refrigerator. Namely, since the heater *h*, as shown in FIG. 4, is provided to a lower outside of the icemaker body 11, the heat generated from the heater *h* is supplied to the inside of the refrigerator as well as the icemaker. Thus, once the heat generated from the heater *h* is supplied to the inside of the refrigerator, objects supposed to be stored at a low temperature are heated. Moreover, if the heat generated from the heater *h* is supplied to the inside of the refrigerator, the refrigerator is overheated.

So, the refrigerator heater according to the present embodiment includes a heater shielding unit to prevent the heat generated from the heater *h* from entering the inside of the refrigerator. And, the heater shielding unit is explained in detail with reference to the attached drawing as follows.

Figure 6:
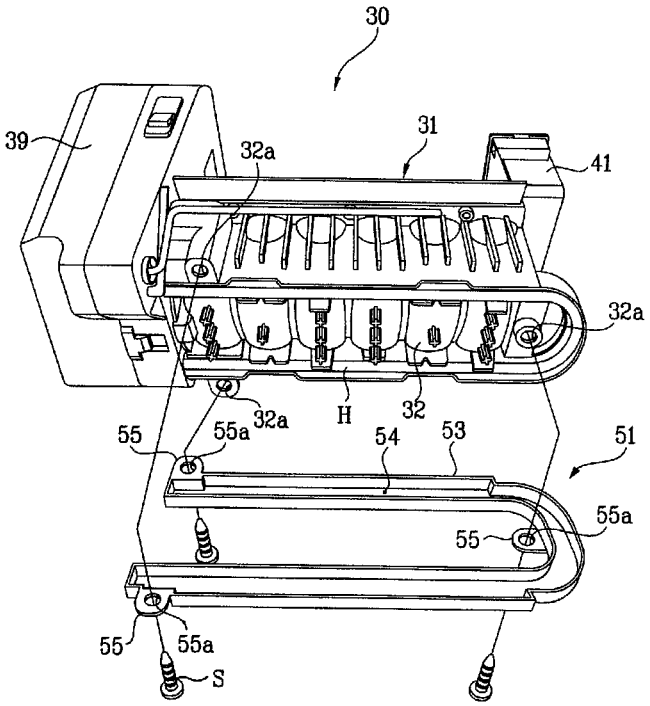
FIG. 6 is a perspective diagram of a backside of the icemaker shown in FIG. 5.

FIG. 6 is a perspective diagram of a backside of the icemaker shown in FIG. 5, in which the heater shielding unit is shown.

Referring to FIG. 6, a heater H is provided to a bottom of an ice-making tray 32. As mentioned in the foregoing description, the heater H is provided to facilitate ice made in the ice-making tray 32 to be detached from the ice-making tray 32. In particular, if the ice-making tray 32 is heated by the heater H, the ice melts in part to be easily detached from the ice-making tray 32 by a rotational motion of an ejector 35. Preferably, the heater H, as shown in the drawing, is configured to have a 'U' shape along a bottom circumference of the ice-making tray 32.

The refrigerator icemaker according to the present embodiment preferably includes a heater cover 51 as a heater shielding unit that prevents the heat generated from the heater H from entering the inside of the refrigerator.

The heater cover 51 is detachably fixed to the bottom of the ice-making tray 32 and prevents the heat from the heater H from being externally discharged out of the icemaker 30. So, the heat is prevented from entering the inside of the refrigerator.

The heater cover 51 includes a cover body 53 accommodating the heater H therein and a locking unit fixing the cover body 53 to the icemaker 30 detachably.

Preferably, the cover body 53 is configured to have a 'U' shape to be matched to the shape of the heater H. The cover body 53 substantially plays a role in shielding the heater H. And, a loading recess 54 is provided to the cover body 53 along an inside thereof to provide a space for loading the heater H therein. So, if the heater H is loaded in the loading recess 54 of the cover body 53 and if the cover body 53 is provided to the bottom of the icemaker 30, the heater H is shielded not to be exposed from the icemaker 30. Preferably, the cover body 53 includes an isolating member to effectively cut off heat generated from the heater H.

Meanwhile, the locking unit can include at least one locking rib 55 provided to the cover body 53 to have a perforated hole 55*a* and a locking member S passing through the perforated hole 55*a* to be locked to the icemaker body 41.

In FIG. 6, there are three locking ribs 55. and, the number of the locking ribs is appropriately adjustable. Meanwhile, a locking hole 32*a* is provided to the bottom of the ice-making tray 32 in correspondence to the locking rib 55.

And, a screw S forming the locking member is locked to the locking hole 32*a*. In the drawing, three locking holes 32*a* are provided to the bottom of the ice-making tray 32 in correspondence to the locking ribs 55. So, as the screws S pass through the perforated holes 55*a* of the locking ribs 55 to be locked to the locking holes 32*a*, respectively, the cover body 53 is fixed to the bottom of the ice-making tray 32.

Besides, an unexplained reference number '39' in FIG. 5 or FIG. 6 indicates a housing. As mentioned in the foregoing description, various parts including a driving motor (not shown in the drawings) for driving an ejector 35 and the like are installed within the housing 39.

A process for making ice in a refrigerator icemaker according to a preferred embodiment of the present invention is explained as follows.

First of all, water is supplied to the water supply hopper 41 from an external water supply source or a separate water supply source within the refrigerator.

The supplied water is then delivered to the ice-making tray 32 from the water supply hopper 41. In this case, since the open topside of the water supply hopper 41 is shielded by the hopper copper 45, the water supplied from the water supply hose with a relatively high water pressure can be prevented from splashing out of the water supply hopper 41.

Meanwhile, the water delivered to the ice-making tray 32 is frozen into ice by the cold air within the refrigerator. After completion of making ice, the ice is detached from the ice-making tray 32 by the heat generated from the heater H provided under the ice-making tray 32. In doing so, the heater H is shielded by the heater cover 51. So, while the heater H generates the heat to separate the ice from the ice-making tray 32, it is able to prevent a user from being burnt by the heat of the heater H or protect the cool or frozen storage of food against the heat delivered to the inside of the refrigerator.

After the ice has been made, it is taken out of the ice-making tray 32 by a rotational motion of the ejector 35. In doing so, the taken-out ice is prevented from re-entering the ice-making tray 32 owing to the stripper 37.

Figure 1:
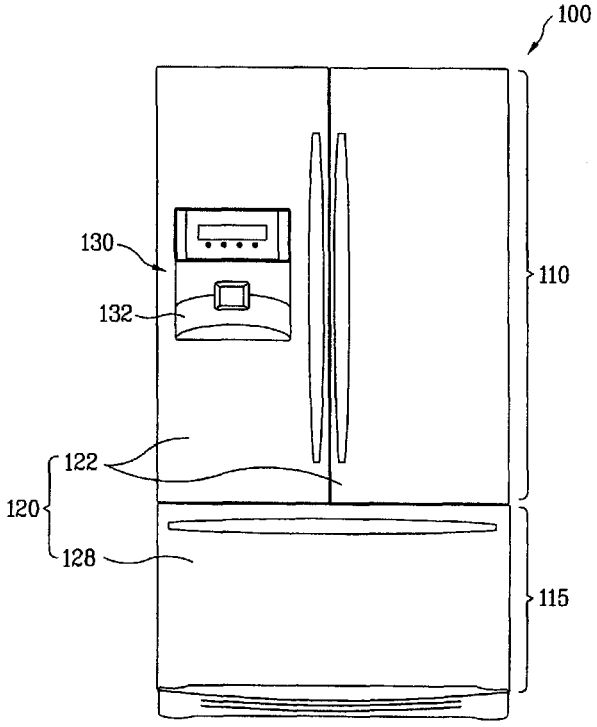
FIG. 1 Prior Art
FIG. 1 is a front diagram of an exterior of a refrigerator according to a related art.
Figure 2:
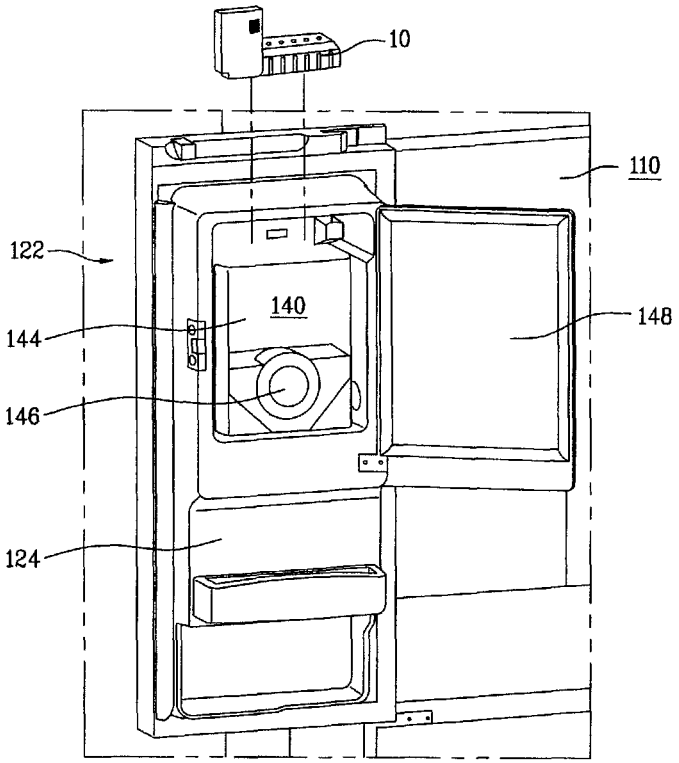
FIG. 2 Prior Art
FIG. 2 is a perspective diagram of a backside of a cooling chamber door shown in FIG. 1.

Subsequently, the ice taken out of the ice-making tray 32 is stored in the ice bank (cf. '144' in FIG. 2) under the ice-making tray 32. the stored ice is then supplied to the taking-out part of the dispenser (cf. '130' in FIG. 1) by the transferring device cf. '146' in FIG. 2).

A process for assembling the hopper cover to the water supply hopper according to a preferred embodiment of the present invention is explained in detail as follows.

First of all, the hopper cover 45 is moved toward the open topside of the water supply hopper 41 to be slant at a prescribed angle in order to insert the locking projection 46 to be inserted in the locking recess 42*a* of the water supply hopper 41. In this case, each of the upper end portions of the both of the lateral sides of the water supply hopper 41 starts to be inserted in the insertion recess 47 provided between the locking projection 46 and the protruding member 49 of the hopper cover 45.

Subsequently, the locking projection 46 is inserted in the locking recess 42*a* and each of both of the later side upper end portions of the water supply hopper 41 is inserted in the insertion recess 47. The other end of the hopper cover 45 is then rotated at a prescribed angle centering on one end portion of the hopper cover 45 provided with the locking projections 46 and the insertion recesses 47. If so, the hopper cover 45 rotates centering on one end portion to gradually shield the open topside of the water supply hopper 41.

Meanwhile, if the hopper cover 45 keeps rotating centering on the one end portion, the other end portion of the hopper cover 45 closely adhere to the upper circumference of the water supply hopper 41 as soon as the protruding member 49 closely adheres to the inner surface of the water supply hopper 41. And, the locking hook 48 of the hopper cover 45 is elastically locked to the locking hole 44 of the water supply hopper 41. In this case, as the holding sill 48*a* of the locking hook 48 closely adheres to the bottom of the locking piece 43 adjacent to the locking hole 44, the locking hook 48 elastically locked to the locking hole 44 is prevented from being released from the elastic locking status.

Accordingly, the present invention provides the following effects or advantages.

First of all, since a heater facilitating detachment of ice made in an ice-making tray is shielded by a heater cover, a user is prevented from being burnt by heat of the heater. Hence, a user is able to use a refrigerator more safely.

Secondly, since a heater is shielded by a heater cover, it is able to minimize heat of a heater to be transferred to an inside of a refrigerator. Hence, it is able to prevent cooling or freezing efficiency from being lowered by the increasing temperature within the refrigerator due to the heat of the heater.

Thirdly, a topside of a water supply hopper is shielded by a hopper cover to prevent water from splashing via the topside of the water supply hopper. So, the water splashing output of the water supply hopper is not frozen into ice or frost within a refrigerator. Hence, it is able to use the refrigerator more sanitarily.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator comprising:

a main body having a compartment;

a door selectively opening and closing the compartment;

an icemaker disposed on the door;

wherein the icemaker comprises:

an ice making tray having a locking hole in a bottom wall thereof;

a water supply hopper mounted on the ice making tray;

a hopper cover detachably coupled to the water supply hopper to open and close a top side of the water supply hopper;

a heater that contacts a bottom surface of the icemaker tray;

a heater shielding unit having a perforated hole; and a screw passing through the perforated hole and the locking hole to couple the heater shielding unit to the ice making tray.

2. The refrigerator according to claim 1, wherein the hopper cover is rotatably attached to the hopper.

3. The refrigerator according to claim 1, further comprising:

a rotational motion fixing part provided to one end portion of the hopper cover; and a locking part provided to the other end portion of the hopper cover.

4. The refrigerator according to claim 3, wherein the rotational motion fixing part comprises:

a locking projection projected from the one end portion of the hopper cover; and a locking rib provided to the water supply hopper to have a locking recess in correspondence to the locking projection.

5. The refrigerator according to claim 4, wherein at least one of the locking projection and the locking rib is formed of an elastic substance.

6. The refrigerator according to claim 5, wherein the locking projection is formed of an elastic substance.

7. The refrigerator according to claim 5, wherein the locking rib is formed of an elastic substance.

8. The refrigerator according to claim 3, wherein the locking part comprises:

a locking hook provided to the other end portion of the hopper cover; and a locking piece provided to the water supply hopper in correspondence to the locking hook.

9. The refrigerator according to claim 8, wherein the locking part further comprises, an elastic unit configured to give an elastic force if the locking hook is selectively fixed to the locking piece.

10. The refrigerator according to claim 9, wherein the elastic unit comprises an elastic opening provided to one side of the hopper cover adjacent to the locking hook.

11. The refrigerator according to claim 1, wherein the water supply hopper includes an open lateral side such that the water is supplied to the water supply hopper via the open lateral side.

12. The refrigerator according to claim 1, further comprising:

a protruding member provided to a bottom of the hopper cover in correspondence to an upper end of the water supply hopper to prevent water from being discharged from the water supply hopper via the open topside of the water supply hopper.

* * * * *